United States Patent [19]

Toyoda et al.

[11] Patent Number: 4,713,941

[45] Date of Patent: Dec. 22, 1987

[54] CRYOGENIC VESSEL

[75] Inventors: Katsuyoshi Toyoda; Takashi Murai, both of Kobe, Japan

[73] Assignee: Mitsubishi Denki Kabushiki Kaisha, Japan

[21] Appl. No.: 934,992

[22] Filed: Nov. 26, 1986

[30] Foreign Application Priority Data

Nov. 28, 1985 [JP] Japan ..... 60-266154
Nov. 28, 1985 [JP] Japan ..... 60-266155
Nov. 28, 1985 [JP] Japan ..... 60-266156

[51] Int. Cl.[4] ..... F17C 7/02
[52] U.S. Cl. ..... 62/50; 62/383
[58] Field of Search ..... 62/64, 50, 383

[56] References Cited

U.S. PATENT DOCUMENTS 2,707,377 5/1955 Morrison ..... 62/50
3,133,422 5/1964 Paivanas ..... 62/50
3,866,785 2/1975 Conte ..... 62/50
4,056,949 11/1977 Hahn ..... 62/64
4,107,937 8/1978 Chmiel ..... 62/64
4,162,677 7/1979 Gregory ..... 62/50

*Primary Examiner*—Ronald C. Capossela
*Attorney, Agent, or Firm*—Leydig, Voit & Mayer

[57] ABSTRACT

A cryogenic vessel comprises a liquid helium tank including a substantially flat top wall and which contains therein a cryogen-cooled electrical apparatus. The helium tank is surrounded by a radiation shield provided with a cooling tube through which evaporated helium gas flows and the radiation shield is then surrounded by an outer housing. In order to evenly cool the top wall of the cryogen tank, it is provided with a heat conducting plate, a cooling coil or a plurality of evenly distributed inlets for substantially evenly cooling it.

5 Claims, 5 Drawing Figures

CRYOGENIC VESSEL

BACKGROUND OF THE INVENTION

This invention relates to a cryogenic vessel and particularly, to a cryogenic vessel for maintaining an electrical apparatus such as a superconducting coil at a cryogenic temperature.

FIGS. 1 and 2 illustrate a conventional cryogenic vessel disclosed in Japanese Patent Laid-Open No. 56-116555. The conventional cryogenic vessel comprises a liquid helium tank 10 having a substantially flat top wall 12, a bottom wall 14 and side walls 16. The liquid helium tank 10 is made of stainless steel since it must be made of a mechanically strong, highly weldable material. The liquid helium tank 10 hermetically contains therein an electrical apparatus 18 such as a superconducting coil to be maintained at a cryogenic temperature. The electrical apparatus 18 is surrounded and cooled by a cryogen 20 such as liquid helium at a cryogenic temperature.

The cryogenic vessel also comprises a radiation shield 22 enclosing the liquid helium tank 10 and an outer housing 24 enclosing the radiation shield 22. The radiation shield 22 is for shielding the cryogen tank 10 against heat radiation from the outer housing 24. The radiation shield 22 and the cryogen tank 10 are supported by a plurality of thermally insulating supports 26 in a thermally insulating relationship.

The cryogenic vessel further comprises a cooling tube 28 for passing therethrough evaporated cryogen or the cryogen gas 30 in the helium tank 10 along the radiation shield 22 for evenly cooling the radiation shield 22. The cooling tube 28 is generally coiled or wound in a serpentine manner and is bonded to the radiation shield 22 in a good heat conducting relationship so that substantially the entire surface of the radiation shield 22 is substantially uniformly cooled. The cooling tube 28 has its single inlet 32 open at the center of the top wall 12 of the liquid helium tank 10 and has its outlet 34 passing through the top wall of the outer housing 24 to communicate with the exterior of the housing 24.

Since there is a temperature difference of about 300° K. between the outer housing 24 and the liquid helium tank 10, a large amount of radiant heat proportional to the difference between the fourth power of the absolute temperatures as understood from the Steeven Boltsmann' law would intrude into the helium tank 10 from the outer housing 24 to evaporate a large amount of the liquid helium 20 if no radiation shield 22 were provided. The radiation shield 22 serves to prevent the direct intrusion of the radiant heat from the outer housing 24 into the helium tank 10, the lower the temperature of the radiation shield 22, the smaller the amount of heat that intrudes into the liquid helium tank 10. Therefore, the radiation shield 22 is provided on its surface with the cooling tube 28 so that the radiation shield 22 can be cooled by cold helium vapour.

Since the conventional cryogenic vessel is constructed as described above, when the liquid volume tank 10 contains a sufficient amount of liquid helium 20 as shown in FIG. 1, the upper portion of the helium tank 10 above the liquid helium level is sufficiently cooled by the evaporated helium 30 above the level of the liquid helium 20. Therefore, the radiant heat coming into the liquid helium 20 from the outer housing 24 is sufficiently small and the amount of evaporation of the liquid helium 20 is small.

However, when the level of the liquid helium within the tank 10 becomes low as illustrated in FIG. 2 due to evaporation, the helium gas 30 flows substantially along the paths shown by the arrows from the surface of the liquid helium 20 toward the inlet 32 of the cooling tube 28. Therefore, the heliuim gas 30 does not sufficiently contact the upper corners of the helium tank 10, and these portions of the tank 10 are not sufficiently cooled. This insufficient cooling of the corner portions of the helium tank 10 is aggravated by the fact that the tank 10 is made of stainless steel which has poor heat conductivity. Therefore, the temperature of the upper corners of the helium tank 10 rises due to the radiant heat from the outer housing 24, so that the radiant heat intruding into the helium tank 10 increases, thereby further increasing the amount of evaporation of the liquid helium 20.

SUMMARY OF THE INVENTION

Accordingly, an object of the present invention is to provide a cryogenic vessel in which the upper portion of the liquid helium tank of the vessel can be maintained at a sufficiently low temperature.

Another object of the present invention is to provide a cryogenic vessel in which the radiation shield is evenly cooled at a low temperature.

Still another object of the present invention is to provide a cryogenic vessel in which the amount of evaporation of the liquid helium within the helium tank is decreased.

With the above objects in view, the cryogenic vessel of the present invention comprises a cryogen tank including a substantially flat top wall and containing therein an electrical apparatus and a cryogen, a radiation shield, enclosing the cryogen tank, for shielding the cryogen tank against heat radiation from the outside, an outer housing enclosing therein the radiation shield. The cryogenic vessel also comprises a cooling tube for passing evaporated cryogen in the cryogen tank on the radiation shield for substantially uniformly cooling it. The cooling tube has its inlet in the top wall of the cryogen tank and has its outlet in the wall of said outer housing. The cryogenic vessel further comprises a cooling device disposed on the top wall of the cryogen tank for substantially uniformly cooling it.

The cooling device may be a heat conduction plate disposed in a heat transferring relationship with the top wall of the cryogen tank and thermally coupled with the inlet of the cooling tube, or alternatively, the cooling device may be a cooling coil having an inlet opened at the top wall of the cryogen tank. The cooling device may also be a plurality of inlets of the cooling tube which are substantially evenly distributed on the top wall of the cryogen tank.

BRIEF DESCRIPTION OF THE DRAWINGS

The present invention will become more readily apparent from the following detailed description of the preferred embodiments thereof taken in conjunction with the accompanying drawings, in which.

DESCRIPTION OF THE PREFERRED EMBODIMENTS

Figure 1:
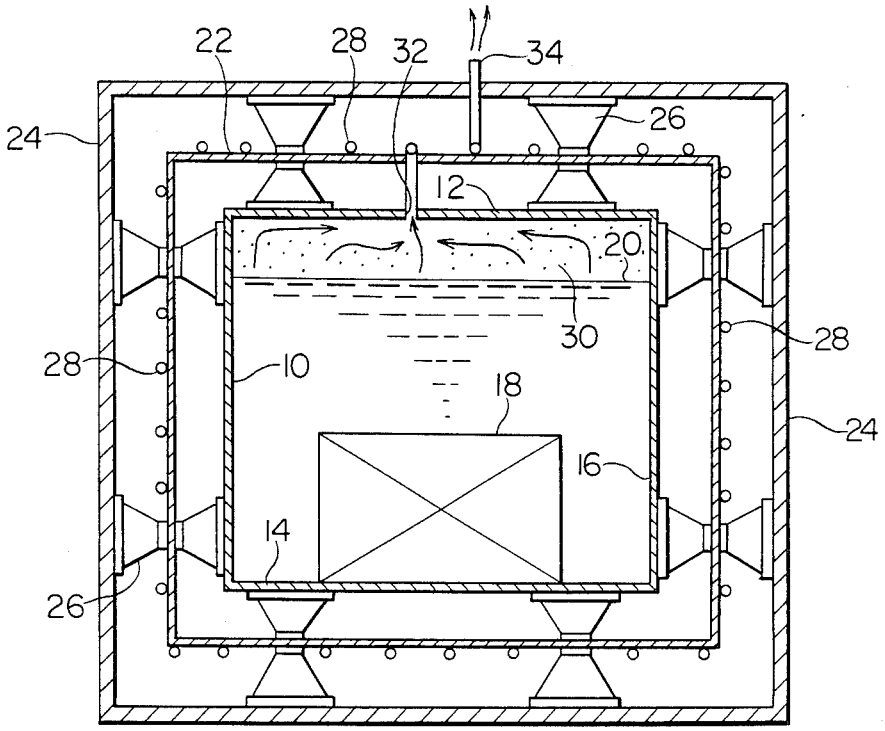
FIG. 1 PRIOR ART
FIG. 1 is a schematic sectional view of a conventional cryogenic vessel in which the helium tank is sufficiently filled with liquid helium.
Figure 2:
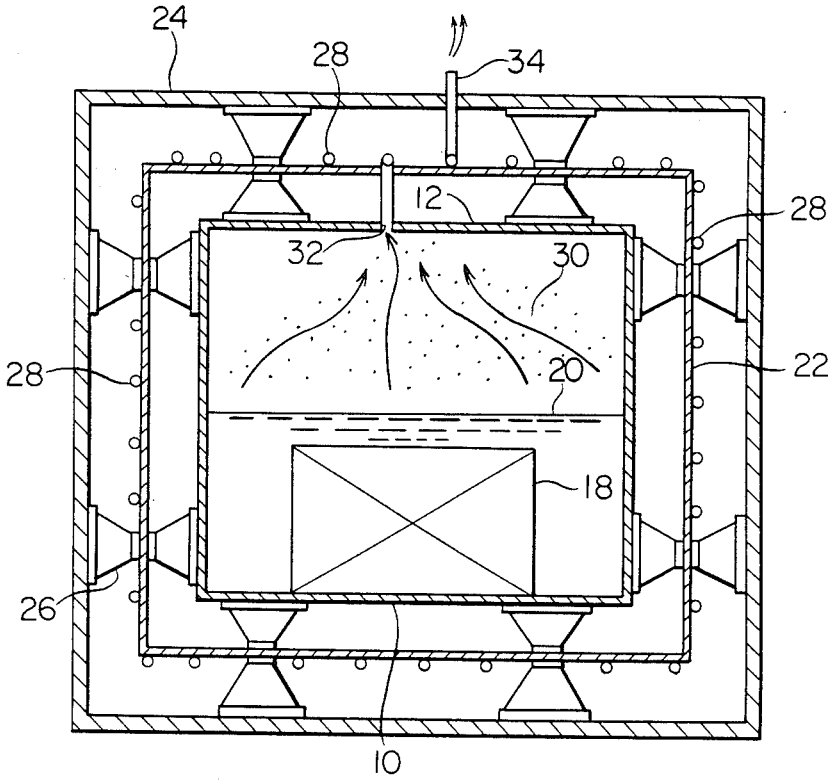
FIG. 2 PRIOR ART
FIG. 2 is a vie similar to FIG. 1 but showing the state wherein a large amount of the liquid helium is evaporated.
Figure 3:
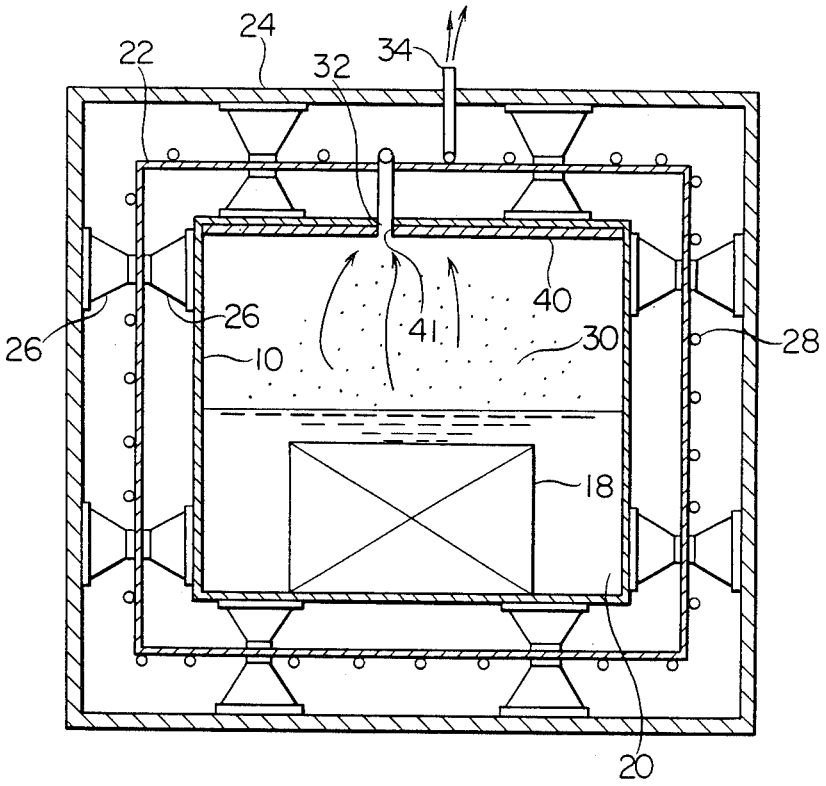
FIG. 3 is a schematic sectional view of one preferred embodiment of the cryogenic vessel of the present invention in which a heat conducting plate is provided on the cryogen tank.

FIG. 3 illustrates, in a schematic sectional view, one embodiment of the cryogenic vessel of the present invention. Comparing the structure of the cryogenic vessel shown in FIG. 3 with that of the conventional cryogenic vessel shown in FIGS. 1 and 2, it is apparent that the cryogenic vessel of the present invention shown in FIG. 3 is additionally provided, at the top wall 12 of the cryogen tank 10, with cooling means for evenly cooling the top wall 12 of the cryogen tank 10. In the embodiment illustrated in FIG. 3, the cooling means is a heat conducting plate 40 made of a single plate of a good heat conducting material such as copper. The heat conducting plate 40 extends over substantially the entire inner surface of the top wall 12 of the cryogen tank 10 and is intimately attached thereto so that a good heat conducting relationship is established between the top wall 12 and the conducting plate 40. It is seen that the heat conducting plate 40 has an aperture 41 in a position corresponding to the position of the inlet 32 of the cooling tube 28 so as to allow the flow of helium gas 30 to pass therethrough and enter into the cooling tube 28. The heat conducting plate 40 may also be attached on the outer surface of the top wall 12 of the cryogen tank 10.

As the helium gas 30 flows along the path shown by the arrows and enter into the inlet 32 of the cooling tube 28, the heat conducting plate 40 is sufficiently cooled only at its center and around the inlet aperture 41 as previously explained. This cold temperature is conducted through the heat conducting plate 40 which is a good heat conducting member. Thus, even when the edge or the periphery of the top wall 12 of the cryogen tank 10 or the upper corners of the cryogen tank 10 are not sufficiently cooled, the periphery of the heat conducting plate 40 is maintained at a sufficiently low temperature due to its superior heat conductivity.

Figure 4:
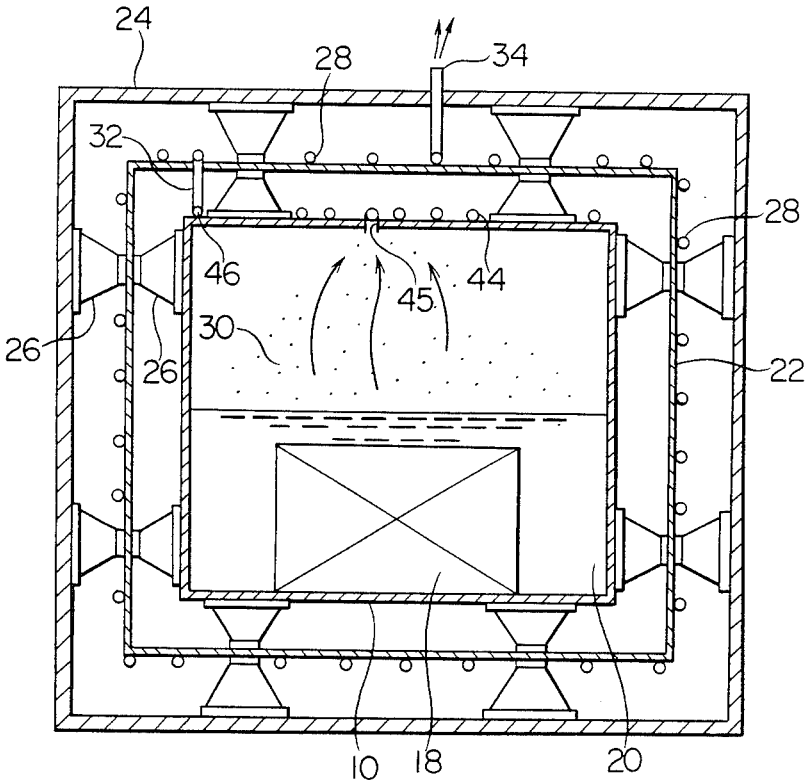
FIG. 4 is a schematic sectional view of another embodiment of the cryogenic vessel of the present invention in which a cooling coil is provided on the cryogen tank.

FIG. 4 illustrates another embodiment of the present invention in which the cooling means comprises a cooling coil 44 disposed on the top wall 12 of the cryogen tank 10. The cooling coil 44 has an inlet 45 opened at about the center of the top wall 12 of the cryogen tank 10. The cooling coil 44 is wound into a coil which is substantially evenly distributed on and attached to the top wall 12 of the cryogen tank 10 in a good thermally conductive relationship. The cooling coil 44 has an outlet 46 connected to the inlet 32 of the cooling tube 28 disposed on the radiation shield 22. The cooling coil 44 may be attached to the inner surface of the top wall 12 of the cryogen tank 10.

In this embodiment, the cold helium gas 30 flowing as shown by the arrows within the cryogen tank 10 enters into the cooling coil 44 through the inlet 45. As the helium gas flows through the evenly distributed cooling coil 44, the top wall 12 of the cryogen tank 10 is evenly cooled. The helium gas leaving the cooling coil 44 from the outlet 46 enters into the inlet 32 of the cooling tube 28 on the radiation shield 22 to cool it. Thus, the top wall 12 of the cryogen tank 10 is substantially evenly cooled even when the level of the liquid helium within the tank 10 is low, so that thermal radiation intruding into the liquid helium is small.

Figure 5:
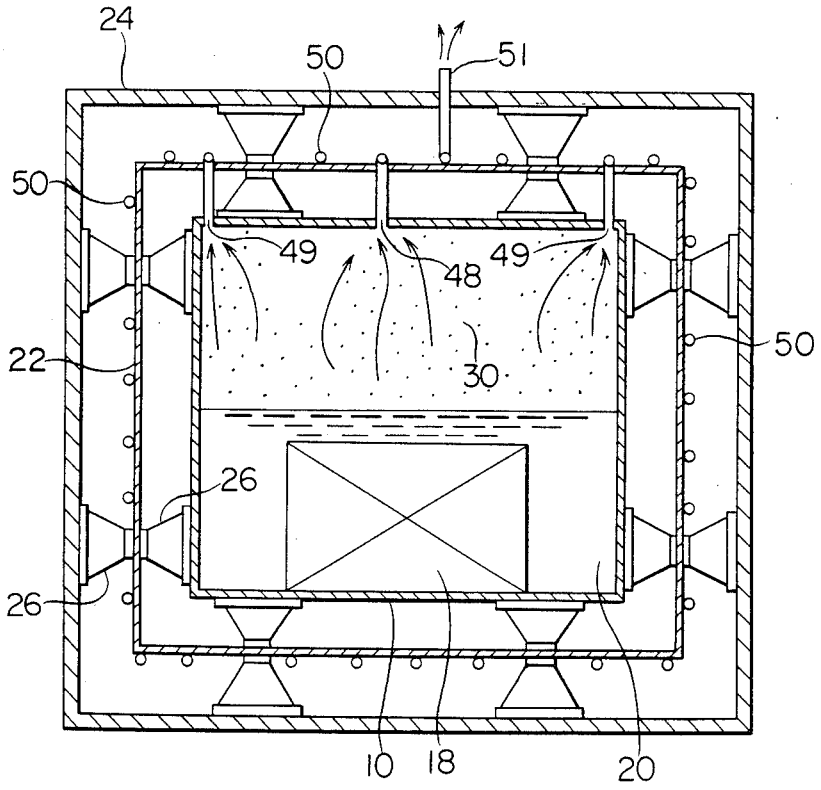
FIG. 5 is a schematic sectional view of still another embodiment of the cryogenic vessel of the present invention in which a cooling tube on the radiation shield has a plurality of evenly distributed inlets on the cryogen tank.

FIG. 5 illustrates still another embodiment of the cryogenic vessel of the present invention in which the cooling means comprises a plurality of evenly distributed inlets 48 and 49 of the cooling tube 50. The cooling tube 50 attached on the radiation shield 22 extends over the entire surface of the radiation shield 22 so that the radiation shield is evenly cooled by the helium gas flowing through the cooling tube 50. The plurality of inlets 48 and 49 are substantially evenly distributed on the top wall 12 of the cryogen tank 10 so that the flow of cold helium gas 30 evenly generates in the space in the cryogen tank 10 above the level of the liquid helium to evenly cool the top wall 12 of the cryogen tank 10. In the illustrated embodiment, the inlet 48 is located at about the center of the top wall 12 and the inlets 49 are located at the peripheral or corner portions of the top wall 12 of the cryogen tank 10. The plurality of inlets 48 and 49 are connected to the cooling tube 50 at suitable locations so that the helium gas flowing therethrough is collected and exhausted through the outlet 51.

In this embodiment, since a plurality of inlets 48 and 49 of the cooling tube 50 are provided substantially evenly in the top wall 12 of the cryogen tank 10, a plurality of helium gas flows are generated substantially evenly. Therefore, the top wall 12 of the cryogen tank 10 can be maintained at a uniform low temperature.

What is claimed is:

1. A cryogenic vessel for maintaining an electrical apparatus at a cryogenic temperature, comprising:

a cryogen tank including a substantially flat top wall and containing therein the electrical apparatus and a cryogen for cooling said electrical apparatus;

a radiation shield, enclosing said cryogen tank, for thermally shielding said cryogen tank against heat radiation from the outside;

an outer housing enclosing therein said radiation shield;

thermally insulating support means for supporting said cryogen tank and said radiation shield in a thermally insulating relationship;

a cooling tube for passing evaporated cryogen in said cryogen tank on said radiation shield for substantially uniformly cooling said radiation shield, said cooling tube having its inlet in the of said outer housing; and cooling means disposed on the top wall of said cryogen tank for substantially uniformly cooling the top wall of said cryogen tank.

2. A cryogenic vessel as claimed in claim 1, wherein said cooling means comprises a heat conducting plate disposed in a heat conducting relationship with the top wall of said cryogen tank, said heat conducting plate being thermally coupled with the inlet of said cooling tube.

3. A cryogenic vessel as claimed in claim 1, wherein said cooling means comprises a cooling coil disposed on the top wall of said cryogen tank, said cooling coil having an inlet opened at the top wall of said cryogen tank.

4. A cryogenic vessel as claimed in claim 3, wherein said cooling coil has an outlet connected to the inlet of said cooling tube.

5. A cryogenic vessel as claimed in claim 1, wherein said cooling means comprises a plurality of inlets of said cooling tube, said plurality of inlets being substantially evenly distributed on said top wall of said cryogen tank.

* * * * *